US011006487B2

(12) United States Patent
Lindberg-Poulsen et al.

(10) Patent No.: US 11,006,487 B2
(45) Date of Patent: May 11, 2021

(54) MICROWAVE POWERED SENSOR ASSEMBLY FOR MICROWAVE OVENS

(71) Applicant: DANMARKS TEKNISKE UNIVERSITET, Kgs. Lyngby (DK)

(72) Inventors: Kristian Lindberg-Poulsen, Copenhagen (DK); Henrik Schneider, Tune (DK); Thomas Andersen, Valby (DK)

(73) Assignee: Danmarks Tekniske Universitet, Kgs. Lyngby (DK)

( * ) Notice: Subject to any disclaimer, the term of this patent is extended or adjusted under 35 U.S.C. 154(b) by 713 days.

(21) Appl. No.: 15/565,250

(22) PCT Filed: Apr. 8, 2016

(86) PCT No.: PCT/EP2016/057790
§ 371 (c)(1),
(2) Date: Oct. 9, 2017

(87) PCT Pub. No.: WO2016/162498
PCT Pub. Date: Oct. 13, 2016

(65) Prior Publication Data

US 2018/0077762 A1 Mar. 15, 2018

(30) Foreign Application Priority Data

Apr. 10, 2015 (EP) ..... 15163201

(51) Int. Cl.
*H05B 6/64* (2006.01)
*H05B 6/68* (2006.01)
(Continued)

(52) U.S. Cl.
CPC ..... *H05B 6/6455* (2013.01); *A61J 9/02* (2013.01); *H05B 6/6452* (2013.01);
(Continued)

(58) Field of Classification Search
CPC ..... A61J 9/02; H05B 6/6452; H05B 6/6455; H05B 6/6467; H05B 6/66; H05B 6/664; H05B 6/686; H05B 6/687
(Continued)

(56) References Cited

U.S. PATENT DOCUMENTS 3,494,722 A 2/1970 Gray
4,088,863 A 5/1978 Jellies
(Continued)

FOREIGN PATENT DOCUMENTS

DE 202004003446 U1 8/2004
EP 1757862 A2 2/2007
(Continued)

OTHER PUBLICATIONS

Pedreño-Molina et al., "Design and Validation of a Ten-Port Waveguide Reflectometer Sensor: Application to Efficiency Measurement and Optimization of Microwave Heating Ovens", Sensors 2008, 8, 7833-7849.
(Continued)

*Primary Examiner* — Dana Ross
*Assistant Examiner* — Ket D Dang
(74) *Attorney, Agent, or Firm* — Lowenstein Sandler LLP

(57) ABSTRACT

The present invention relates to a microwave powered sensor assembly for microwave ovens. The microwave powered sensor assembly includes a microwave antenna to generate an RF antenna signal in response to microwave radiation at a predetermined excitation frequency. A direct current (dc) power supply circuit of the microwave powered sensor assembly is operatively coupled to the RF antenna signal to extract energy from the RF antenna signal and produce a power supply voltage. A sensor is connected to the
(Continued)

power supply voltage and configured to measure a physical or chemical property of a food item under heating in a microwave oven chamber.

16 Claims, 7 Drawing Sheets

(51) Int. Cl.
*A61J 9/02* (2006.01)
*H05B 6/66* (2006.01)

(52) U.S. Cl.
CPC ..... *H05B 6/6467* (2013.01); *H05B 6/66* (2013.01); *H05B 6/686* (2013.01); *H05B 6/687* (2013.01); *H05B 6/664* (2013.01)

(58) Field of Classification Search
USPC ..... 219/1.55 R, 1.55 E, 1.55 M, 450, 494, 219/506, 1.55 B; 340/27 R, 210, 224, 340/417, 227 R, 228 R; 99/326, 329 R, 99/342; 325/37, 185, 494; 333/227, 248, 333/253
See application file for complete search history.

(56) References Cited

U.S. PATENT DOCUMENTS

| | | | | |
|---|---|---|---|---|
| 4,144,435 | A | 3/1979 | Clark et al. | |
| 4,197,442 | A | 4/1980 | Carlsson et al. | |
| 4,230,731 | A * | 10/1980 | Tyler | G01K 1/024 219/713 |
| 4,297,557 | A | 10/1981 | Tyler et al. | |
| 4,377,733 | A * | 3/1983 | Yamaguchi | G01K 1/024 219/516 |
| 4,467,163 | A | 8/1984 | Pauly et al. | |
| 4,471,193 | A | 9/1984 | Walter | |
| 4,590,348 | A | 5/1986 | Lahti et al. | |
| 4,626,858 | A | 12/1986 | Copeland | |
| 4,741,348 | A * | 5/1988 | Kikuchi | A61N 5/02 607/102 |
| 5,237,141 | A * | 8/1993 | Yoshino | H05B 6/6447 219/703 |
| 5,745,082 | A | 4/1998 | Alder | |
| 5,994,683 | A * | 11/1999 | Braunisch | F24C 7/087 219/704 |
| 6,208,903 | B1 | 3/2001 | Richards et al. | |
| 6,844,535 | B2 | 1/2005 | Yang | |
| 8,188,409 | B2 | 5/2012 | Baier | |
| 2001/0000403 | A1* | 4/2001 | Gaisford | G01N 30/30 219/748 |
| 2002/0157411 | A1 | 10/2002 | Ishikawa et al. | |
| 2004/0051368 | A1 | 3/2004 | Caputo et al. | |
| 2004/0056027 | A1 | 3/2004 | Miller | |
| 2004/0238623 | A1 | 12/2004 | Asp | |
| 2006/0022800 | A1 | 2/2006 | Krishna et al. | |
| 2006/0207442 | A1 | 9/2006 | Pettersson | |
| 2006/0213904 | A1 | 9/2006 | Kates | |
| 2007/0210867 | A1 | 9/2007 | Bulkes et al. | |
| 2007/0229266 | A1 | 10/2007 | Gibson | |
| 2007/0235448 | A1 | 10/2007 | Lihl et al. | |
| 2008/0243088 | A1 | 10/2008 | Evans | |
| 2009/0074631 | A1 | 3/2009 | Longo | |
| 2009/0315727 | A1 | 12/2009 | Goltenboth | |
| 2010/0187224 | A1* | 7/2010 | Hyde | H05B 6/6455 219/720 |
| 2010/0247403 | A1 | 9/2010 | Hancock | |
| 2010/0328037 | A1 | 12/2010 | Thomas et al. | |
| 2012/0119971 | A1 | 5/2012 | Bae | |
| 2013/0080098 | A1* | 3/2013 | Hadad | G01N 22/00 702/66 |
| 2013/0175262 | A1 | 7/2013 | Gharpurey et al. | |
| 2014/0197761 | A1* | 7/2014 | Grandemenge | H05B 6/6447 315/502 |
| 2015/0070029 | A1 | 3/2015 | Libman et al. | |
| 2016/0150602 | A1* | 5/2016 | Bilet | B65D 81/3453 219/712 |

FOREIGN PATENT DOCUMENTS

| | | | |
|---|---|---|---|
| GB | 2 119 127 | A | 11/1983 |
| JP | S5356153 | U | 5/1978 |
| JP | S59144441 | U | 9/1984 |
| JP | H0676835 | U | 10/1994 |
| JP | 2004-138331 | A | 5/2004 |
| JP | 2004222285 | A | 8/2004 |
| JP | 2006166522 | A | 6/2006 |

OTHER PUBLICATIONS

Sonmez et al., "MRI active guidewire with an embedded temperature probe and providing a distinct tip signal to enhance clinical safety", Journal of Cardiovascular Magnetic Resonance, 2012, 14:38.

Tinga, W. R., "Design Principles for Microwave Heating and Sintering", vol. 60, Symposium L—Defect Properties and Processing of High-Technology Nonmetallic Materials, 1985, 105.

Tsoli, A., "Sensor-based management systems based on RFID technology", Diploma Thesis, Jul. 2005.

Yam, K.L. et al, "Intelligent Packaging: Concepts and Applications", vol. 70, Nr. 1, 2005—Journal of Food Science R1 (Abstract).

* cited by examiner

A)

B)

MICROWAVE POWERED SENSOR ASSEMBLY FOR MICROWAVE OVENS

The present invention relates to a microwave powered sensor assembly for microwave ovens. The microwave powered sensor assembly comprises a microwave antenna for generating an RF antenna signal in response to microwave radiation at a predetermined excitation frequency. A dc power supply circuit of the microwave powered sensor assembly is operatively coupled to the RF antenna signal for extracting energy from the RF antenna signal and produce a power supply voltage. A sensor is connected to the power supply voltage and configured to measure a physical or chemical property of a food item under heating in a microwave oven chamber.

BACKGROUND OF THE INVENTION

Microwave ovens are well-known and highly popular kitchen appliances that heat and cook food items by electromagnetic irradiation in the microwave spectrum causing polarized molecules in the food to rotate and build up thermal energy. Microwave ovens are able to heat food quickly and efficiently because excitation is fairly uniform in the outer of dense food items. Microwave ovens are popular for reheating previously cooked foods and cooking a variety of foods. However, the temperature and other physical or chemical properties of the food item under preparation are unknown which may be troublesome to reach an intended state of preparation of the food item in question such as temperature, in particular in view of the rapid food preparation or heating typically attained by microwave ovens.

Hence, it would be advantageous to position an active sensor device or assembly inside the compartment or chamber of the microwave oven that would allow a user or consumer to monitor certain physical or chemical properties of the food item under preparation. Due to the extremely EMI hostile environment inside the oven compartment it may be unsafe to place batteries or similar chemical energy storage device for powering the active sensor assembly inside the oven chamber. Furthermore, the need to replace batteries of the active sensor assembly from time to time makes it difficult to make a housing of a battery powered active sensor device or assembly hermetically sealed against the external environment.

U.S. Pat. No. 4,297,557 discloses a microwave oven with a telemetric temperature probe embedded in a comestible held in a cooking utensil to measure food temperature. The temperature probe comprises electronic circuitry including a power supply and a temperature responsive circuit. The power supply circuit includes a loop antenna, rectification diodes and supply capacitor operating by harvesting energy from microwave energy inside the oven. A temperature signal is transmitted wirelessly by near-field magnetic coupling from an inductor antenna of the temperature probe to a receiving inductive antenna outside the oven cavity.

US 2004/0056027 discloses a kettle adapted for heating liquids in a microwave oven. The kettle is equipped with a simple temperature indicator for indicating the temperature of the contents of the boiler for example by changing colors. There is not any specific disclosure of electronic circuitry coupled to the thermometer.

US 2006/0207442 shows a container for placement in a microwave oven and wherein there is arranged a cooling device for cooling the contents of the container. The cooling device is driven by the energy harvested from the microwaves in the oven.

However, the strength of the microwave electromagnetic radiation or microwave field inside the microwave oven is often excessive and may irreversibly damage various active or passive components of a dc power supply circuit, or other electronic circuitry, of a microwave powered active sensor assembly. The component damage may be caused by RF signal voltages, delivered by an RF antenna of the microwave powered sensor assembly in response to the RF electromagnetic radiation, which exceeds a maximum voltage rating and/or maximum power rating of the active or passive components of the dc power supply circuit. Such damaging RF signal voltages may lead to the destruction of the active or passive components of the dc power supply circuit. This is particularly the case where the dc power supply circuit, and possibly additional electronic circuitry, is integrated on a sub-micron CMOS semiconductor substrate which imposes severe restrictions on the voltage level and/or power level that can be tolerated without overheating or break-down of the active or passive components formed in the semiconductor substrate.

Hence, it would be advantageous to be able to limit the amount of power harvested by the RF antenna and supplied to the dc power supply circuit of the microwave powered active sensor assembly when exposed to excessive levels of microwave energy inside the microwave oven. However, since it may be impossible or at least highly impractical to absorb or dissipate large amounts of power in components of a small CMOS semiconductor substrate, it would further be advantageous to prevent too much energy entering the semiconductor substrate.

Furthermore, it is desirable to transmit certain measured parameter values of the desired physical or chemical property or properties of the food item to the outside of the microwave oven chamber during heating of the food item. In this manner, the user or consumer is able to monitor physical or chemical properties of the food item during preparation or cooking and may for example stop the oven when the parameter value in question reaches a target value or a desired value. The transmitted parameter value may be digitally encoded as a data signal and can for example comprise a current or instantaneous temperature of the food item. However, it is generally difficult to reliably transmit wireless data signals out of the microwave oven during food preparation because of the previously discussed excessive strength of the microwave electromagnetic field inside the microwave oven chamber. The microwave electromagnetic field tends to interfere with all types of ordinary RF signals carrying the wireless data signals. To worsen the situation the oven chamber of microwave ovens acts essentially as a Faraday cage designed to block any emission of RF signals to avoid leakage of the potentially harmful microwave radiation to the outside and reach the users. Hence, a reliable, flexible and low cost data signal transmission mechanism is desirable for transmitting the data signal with current parameter values of the measured physical or chemical property of the food item to the outside of the oven chamber.

SUMMARY OF THE INVENTION

A first aspect of the invention relates to a microwave powered, or powerable, sensor assembly for microwave ovens. The microwave powered sensor assembly comprises a microwave antenna having a predetermined tuning frequency for generating a radio frequency (RF) antenna signal in response to microwave radiation at a predetermined excitation frequency. The microwave powered sensor assembly further comprises an RF power limiter coupled to the RF antenna signal for limiting an amplitude or power of the RF antenna signal in accordance with predetermined signal limiting characteristics to produce a limited RF antenna signal. A dc power supply circuit of the microwave powered sensor assembly is coupled to the limited RF antenna signal and configured to rectify the limited RF antenna signal and produce a power supply voltage. A sensor is connected to the power supply voltage and configured to measure a physical or chemical property of a food item under heating in a microwave oven chamber.

One embodiment of the microwave powered sensor assembly is configured for industrial types of microwave ovens using the standardized 915 MHz frequency of emitted microwave radiation. An alternative embodiment of the microwave powered sensor assembly is configured for consumer types of microwave ovens using the standardized 2.45 GHz frequency of emitted microwave radiation. The tuning frequency and possibly physical dimensions of the microwave antenna may for example differ between these types of the microwave powered sensor assembly. In either case, the microwave antenna is responsive to the excitation created by the microwave radiation in the oven chamber of the industrial or consumer variant of microwave oven during heating of a food item placed in the oven chamber. The microwave antenna generates the RF antenna signal and the dc power supply circuit rectifies and extracts energy from either the limited RF antenna signal, or in case the microwave powered sensor assembly lacks the RF power limiter, directly from the received RF antenna signal. The power supply voltage generated by the dc (DC) power supply circuit may be connected to active electronic circuits and components of the microwave powered sensor assembly and supply electrical power thereto. The active electronic circuits and components may comprise the sensor, a digital processor, a display, an optical data transmitter etc. Hence, the microwave powered sensor assembly is able to operate without any battery source by instead relying on energy harvested from the microwave radiation in the oven chamber.

The food item may comprise a liquid such as milk, water, baby formula, coffee, tea, juice or other drinkable substances or the food item may comprise solid or frozen food such as bread, meat or a dinner meal. The food item may be arranged in a suitable container or utensil during the heating of the food item inside the oven chamber. The food container or utensil may comprise a cup, bottle or plate etc. The sensor may be in physical contact with the food item to measure or detect a physical property of the food item during heating or preparation in the oven chamber such as a temperature, viscosity, pressure, colour, humidity, reflectivity, electric conductivity etc. The sensor may be arranged to measure the physical or chemical property, for example temperature, at a core of the food item in question. Alternatively, the sensor may be arranged to measure the physical or chemical property at a surface of the food item for example by contact to an outer surface of the food item. The latter embodiment may be useful to detect whether the surface of a particular food item has reached a target or treatment temperature for hygienic or disinfection purposes. The microwave powered sensor assembly may be housed in a food probe that is inserted into the food item in connection with its preparation in the microwave oven. Some embodiments of the sensor may operate without physical contact to the food item and instead remotely sense/measure the physical property of the food item e.g. using an infrared (IR) temperature detector etc. The sensory portion of the sensor may alternatively or additionally measure or detect a chemical property of a food item under heating for example water content or the presence and/or concentration of certain chemical agents salt, sugar etc. in the food item. The microwave powered sensor assembly may comprise multiple individual sensors of different types or comprise multiple individual sensors of the same type. Multiple individual sensors of different types may be configured to measure different physical properties and/or chemical properties of the food item while multiple sensors of the same type may be configured to measure the physical or chemical property in question, for example temperature, at different locations of the food item for example simultaneously at the core and at the surface of the food item as mentioned above.

The RF power limiter may comprises a variable impedance circuit connected across the RF antenna signal wherein the variable impedance circuit is configured to exhibit a decreasing input impedance with increasing amplitude or power of the RF antenna signal at the predetermined excitation frequency to decrease a matching between the input impedance of the power limiter and an impedance of the microwave antenna.

The variable impedance circuit may be configured to exhibit a substantially constant input impedance at power or amplitude levels of the RF antenna signal below a threshold level; and exhibit a gradually, or abruptly, decreasing input impedance at power or amplitude levels of the RF antenna signal above the threshold level. The input impedance of the variable impedance circuit may for example gradually decrease with increasing input power of the RF antenna signal above the threshold level. The threshold level may be a power threshold or an amplitude threshold.

The variable impedance circuit may comprise a PIN limiter diode or a controlled FET transistor as discussed in further detail below with reference to the appended drawings. The power supply circuit may comprise one or more RF Schottky diode(s) for rectification of the limited RF antenna signal for the reasons discussed in further detail below with reference to the appended drawings.

In some embodiments of the invention the microwave antenna may be detuned with a predetermined frequency amount from the expected excitation frequency, either 2.45 GHz or 915 MHz, of the microwave radiation used to operate the particular embodiment of the microwave powered sensor assembly. The predetermined tuning frequency of the microwave antenna may for example deviate from the predetermined excitation frequency (915 MHz or 2.45 GHz) of the microwave radiation by more than +50% or more than −33% such as at least +100% or at least −50%. The detuning decreases the amount of microwave energy picked-up by the microwave antenna and therefore decreases the level of the RF antenna signal applied to either the RF power limiter (if present) and to the dc power supply circuit and may assist in protecting the latter circuits against excessively high voltage or power levels of the RF antennal signal if the microwave antenna is situated in a hot spot in the oven chamber.

A higher tuning frequency of the microwave antenna than the standardized 2.45 GHz (or 915 MHz) microwave radiation frequency leads to the additional benefit of smaller physical dimensions of the microwave antenna. The smaller physical dimensions leads to various benefits as discussed in further detail below with reference to the appended drawings.

The microwave antenna may comprise at least one of: {a monopole antenna, a dipole antenna, a patch antenna}. The microwave antenna may be integrally formed in a wire or conductor pattern of a carrier or substrate, such as a printed circuit board, supporting the microwave powered sensor assembly. A monopole microwave antenna is generally compact and omnidirectional.

In one embodiment of the invention a generator impedance of the microwave antenna is at least two times larger than an input impedance at the RF power limiter at the predetermined excitation frequency of the microwave radiation.

The microwave powered sensor assembly is preferably enclosed by a housing. The microwave antenna is preferably arranged outside the housing if the latter comprises an electrically conducting material to allow the microwave radiation to reach the microwave antenna substantially without significant attenuation and thereby harvest microwave energy. The electrically conductive housing may comprise a metal sheet or metal net, enclosing and shielding at least the RF power limiter and the power supply circuit against the microwave electromagnetic radiation.

The housing may be hermetically sealed to protect these circuits and sensor enclosed therein against harmful liquids, gasses or other contaminants of the food item or present within the oven chamber. A sensory portion of the sensor may protrude from the housing to allow the sensory portion to obtain physical contact with the food item.

The microwave powered sensor assembly may comprise a digital processor coupled to the power supply voltage for receipt of operating power; wherein the sensor is coupled to the digital processor to via an input port of the processor for receipt of measured parameter values of the physical or chemical property or properties of the food item. The sensor may be configured to deliver the measured parameter values to the input port of the digital processor in digital format or analog format. Various technical details and benefits of the digital processor are discussed in further detail below with reference to the appended drawings.

An advantageous embodiment of the microwave powered sensor assembly comprises an optical data transmitter coupled to the digital processor, or possibly directly to the sensor, for receipt and optical transmission of the measured parameter values of the physical or chemical property or properties of the food item to the exterior of the oven chamber. The optical data transmitter may be configured to emit an optical data signal comprising the measured parameter values encoded in digital format. The optical data signal is transmitted to a suitable optical receiver arranged at the outside of the oven chamber. The skilled person will understand that the optical data signal is entirely immune to the previously discussed excessive levels of microwave radiation inside the oven chamber. Furthermore, optical data transmitters are commercially available in compact form factors and at low costs. The optical data transmitter may comprise a modulated LED diode emitting the optical data signal by light waves in the visible spectrum or light waves in the infrared spectrum. The optical data transmitter may be configured to transmit the optical data signal continuously, at regular time intervals, or at irregular time intervals during heating of the food item depending on the particular application.

The optical receiver may comprise a photodetector such as a LED. The optical receiver may be attached to an outer surface of the glass lid of the microwave oven for receipt of the portion of the optical data signal penetrating the glass lid. If the inner surface of the glass lid is covered by a metallic net or grid, which forms part of the previously discussed Faraday cage of the microwave oven, the photodetector may be placed in an opening/aperture of the metallic net or grid allowing the optical waves carrying the optical data signal unobstructed propagation to the photodetector. The photodetector may be electrically or wirelessly coupled to a microprocessor of the microwave oven and transmit the received optical data signal, comprising the measured parameter values, to a microprocessor or controller of the microwave oven. The microprocessor of the microwave oven may be configured to use the received parameter values to control the operation of the microwave oven. Another embodiment of the microwave powered sensor assembly comprises a parameter indicator for displaying parameter values of the monitored physical or chemical property of the food item to the exterior of the oven chamber. The parameter indicator may be arranged on an outer housing surface of the microwave powered sensor assembly. The parameter indicator may comprise at least one indicator selected from a group of {a LED, multiple LEDs of different color, a loudspeaker, an alphanumeric display, E-ink paper}. The functionality and technical details of the parameter indicator is discussed in further detail below with reference to the appended drawings. However, the use of E-ink paper as parameter indicator is particularly attractive in some applications because E-ink paper allows the measured parameter value or values to be inspected by the user for a long time period after the microwave oven is turned off. The ultra-low power consumption of the E-ink paper allows the latter to remain functional using only the relatively limited amount of energy held on a storage element, e.g. a capacitor, of the dc power supply circuit of the microwave powered sensor assembly.

As mentioned above, the microwave powered sensor assembly may comprise a temperature sensor for example a thermistor.

A second aspect of the invention relates to a food container comprising a microwave powered sensor assembly according to any of the above-described microwave powered sensor assembly embodiments. A sensor, such as a temperature sensor, of the microwave powered sensor assembly is arranged to obtain physical contact or sensory contact with a food item of the food container. Hence, the food container may be empty immediately after manufacturing awaiting a later food filling process at a food manufacturing site or factory. Alternatively, the food container may be filled manually by an end user. Following this subsequent food filling process, the food item held in the food container is brought into sensory contact with the sensor.

The microwave powered sensor assembly may be attached to, or integrated with, the food container in numerous ways. In certain embodiments, the microwave powered sensor assembly is partially or fully embedded in a wall section, lid section, or bottom section of the food container. The microwave powered sensor assembly may be integrated with a material of the food container during a container manufacturing process for example using injection molding or by overmolding material onto an already molded container. The food container may comprise various types of materials such as one or more of: plastic, cardboard, glass and porcelain.

A third aspect of the invention relates to a method of monitoring physical or chemical properties of a food item in connection with heating of the food item in a microwave oven, said method comprising steps of:

a) placing a sensor of a microwave powered sensor assembly according to any of the above-described embodiment thereof arranged in physical or sensory contact with the food item, b) positioning the food item inside an oven chamber of the microwave oven, c) activating the microwave oven to produce microwave electromagnetic radiation at a predetermined excitation frequency inside the oven chamber thereby irradiating and heating the food item; the method further comprising at least one step of:

displaying a parameter value of a measured physical or chemical property of the food item on the microwave powered sensor assembly;

transmitting a parameter value of the physical or chemical property of the food item via a wireless data communication link to a wireless receiver arranged outside the oven chamber.

The wireless data communication link preferably comprises an optical data transmitter for example as discussed above establishing an optical data transmission channel to the previously discussed optical receiver arranged at the outside of the oven chamber. The optical data transmitter may be emitting the optical data signal as light waves in the visible spectrum or in the infrared spectrum.

The method of monitoring the physical or chemical properties of a food item may comprise limiting an amplitude or power of the RF antenna signal in accordance with predetermined signal limiting characteristics of an RF power limiter. The signal limiting characteristics may be carried out by peak-clipping of the signal waveform of the RF antenna signal or by an Automatic Gain Control (AGC) function without distorting the signal waveform of the RF antenna signal.

A fourth aspect of the invention relates to a microwave powered sensor assembly for microwave ovens, comprising a microwave antenna having a predetermined tuning frequency to generate an RF antenna signal in response to electromagnetic radiation at a predetermined excitation frequency. The assembly further comprises a dc power supply circuit coupled to the RF antenna signal and configured to rectify the RF antenna signal and produce a power supply voltage based on the RF antenna signal. A sensor, such as a temperature sensor, is powered by the power supply voltage and configured to measure parameter values of a physical or chemical property of a food item under heating in a microwave oven chamber. The microwave powered sensor assembly additionally comprises a wireless, preferably optical, data transmitter operatively coupled to the sensor for receipt of the measured parameter values of the physical or chemical property and optical transmission of the measured parameter values to the exterior of the oven chamber.

The microwave powered sensor assembly according to the fourth aspect of the invention may additionally comprise an RF power limiter coupled in-between the RF antenna signal and the dc power supply circuit. The RF power limiter is configured to limit an amplitude or power of the RF antenna signal in accordance with signal limiting characteristics of the RF power limiter. The RF power limiter produces a limited RF antenna signal to an input of the dc power supply circuit. The RF power limiter may be identical to the RF power limiter embodiments discussed above in connection with the first aspect of the invention or to any of the embodiments of the RF power limiter discussed in further detail below with reference to the appended drawings.

The microwave powered sensor assembly may comprise a parameter indicator for displaying parameter values of the monitored physical or chemical property of the food item to the exterior of the oven chamber;

wherein the parameter indicator comprises at least one indicator selected from {a LED, multiple LEDs of different color, a loudspeaker, an alphanumeric display, E-ink paper} as discussed above in connection with the first aspect of the invention.

A fifth aspect of the invention relates to a food probe comprising a microwave powered sensor assembly according to any of the above-described embodiment thereof. The a food probe may comprise an elongate housing enclosing and protecting the microwave powered sensor assembly as discussed in further detail below with reference to the appended drawings.

BRIEF DESCRIPTION OF THE DRAWINGS

Preferred embodiments of the invention will be described in more detail in connection with the appended drawings, in which.

DETAILED DESCRIPTION OF PREFERRED EMBODIMENTS

Figure 1:
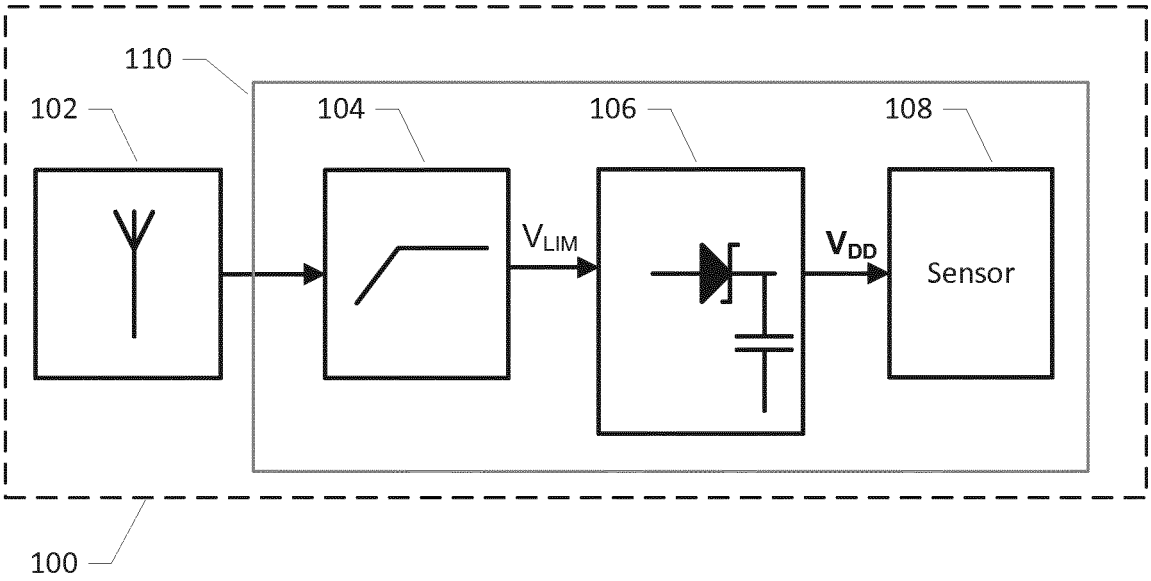
FIG. 1 is a simplified schematic block diagram of a microwave powered sensor assembly for use in microwave ovens in accordance with a first embodiment of the invention.

FIG. 1 shows a simplified schematic block diagram of a microwave powered sensor assembly 100 suitable for use in industrial or consumer types of microwave ovens (not shown) in accordance with a first embodiment of the invention. The microwave powered sensor assembly 100 comprises a microwave antenna 102 with a predetermined tuning frequency in the microwave region for example at tuning frequency between 800 MHz and 3.0 GHz. The microwave antenna 102 is responsive to excitation created by the microwave radiation or electromagnetic field generated in an oven chamber of the industrial or consumer type of microwave oven in question during heating of a food item placed in the oven chamber. The skilled person will understand that the tuning frequency of the microwave antenna 102 may be designed to about 2.45 GHz for microwave powered sensor assemblies designed for a consumer type of microwave oven and to 915 MHz for microwave powered sensor assemblies designed for an industrial type of microwave oven. The tuning frequency of the microwave antenna 102 may furthermore be detuned with a predetermined amount from the expected excitation frequency, either 2.45 GHz or 915 MHz, of the microwave radiation as discussed above.

The food item may comprise a liquid such as milk, water, baby formula, coffee, tea, juice or other drinkable substances or the food item may be solid or frozen and comprise bread, meat or a dinner meal. The food item may be arranged in a suitable container or utensil during heating in the oven chamber such as a cup or plate etc. A sensory portion of a sensor 108 of the microwave powered sensor assembly 100 may be in physical contact with the food item to measure or detect a physical property of the food item during heating/preparation such as a temperature, viscosity, pressure, colour, humidity, electric conductivity etc. In the alternative, the sensor 108 may operate without physical contact to the food item and instead measure the physical property of the food item by remote or non-contact sensing e.g. using an infrared (IR) temperature detector etc. The sensory portion of the sensor 108 may alternatively measure or detect a chemical property of a food item under heating for example water content or the presence and/or concentration of certain chemical agents salt, sugar etc. in the food item.

The skilled person will understand that the sensor may be configured to measure or detect several different physical properties of the food item and/or one or more chemical properties. The microwave powered sensor assembly 100 may comprise multiple individual sensors of different types to measure the different physical properties and/or chemical properties of the food item.

The microwave antenna 102 generates an RF antenna signal in response to the excitation by the RF electromagnetic radiation in the oven chamber. The RF antenna signal is electrically connected or coupled to the input of an optional RF power limiter 104. The RF power limiter 104 is configured to limiting a level such as amplitude, power or energy of the RF antenna signal in accordance with predetermined signal limiting characteristics of the RF power limiter 104. The RF power limiter 104 thereby produces a limited RF antenna signal $V_{LIM}$ at an output of the RF power limiter 104. The predetermined signal limiting characteristics may for example comprise a linear behaviour at relatively small levels of the RF antenna signal, for example below a certain threshold level, and a non-linear behaviour above the threshold level. In this manner, the level of the RF antenna signal and the level of the limited RF antenna signal may be largely identical for RF antenna signals below the threshold level while the level of the limited RF antenna signal may be smaller than the level of the RF antenna signal above the threshold level. Various circuit details and mechanisms to produce different types of signal limiting characteristics of the optional RF power limiter 104 are discussed below in additional detail.

The RF power limiter 104 of the microwave powered sensor assembly 100 is advantageous because the limiter 104 protects the down-stream dc power supply circuit 106, electrically connected or coupled to the limited RF antenna signal, against overvoltage conditions created by excessively large power or amplitude of the RF antenna signal in response to the RF electromagnetic radiation in the oven chamber. These excessive signal input conditions are quite contrary to the operation of normal wireless RF data communication equipment where the challenge often is to obtain sufficient RF power to safely transmit or decode data signals modulated onto the carrier wave. In contrast, the microwave powered sensor assembly 100 will often be placed very close to the source of the RF electromagnetic radiation in the oven chamber leading to excessively large voltages and input power of the RF antenna signal. Furthermore, the strength of the microwave radiation in the oven chamber is often highly variable through the chamber due to standing waves. These standing waves lead to the formation of so-called "hot spots" and "cold spots" inside the oven chamber during operation with highly different field strengths of the microwave radiation. The microwave powered sensor assembly 100 should be configured to at one hand extract sufficient power from the microwave antenna to ensure proper operation when positioned in a cold spot and on the other hand be able to withstand very large amplitude RF antenna signals when the microwave antenna is positioned in hot spot. In the latter situation, the RF power limiter 104 ensures that these large amplitude RF antenna signals are attenuated by reflecting a large portion of the incoming RF signal power back to the microwave antenna for emission as discussed in further detail below.

The dc power supply circuit 106 is configured to rectify the limited RF antenna signal $V_{LIM}$ and extract a dc power supply voltage $V_{DD}$ therefrom. The dc power supply circuit 106 may comprise one or more filter or smoothing capacitor (s) coupled to the output of a rectifying element. Several types of rectifying elements may be used such as semiconductor diodes or actively controlled semiconductor switches/transistors. In one embodiment, the rectifying element comprises a Schottky diode as schematically indicated on circuit block 106. The one or more filter or smoothing capacitor(s) serves to suppress voltage ripple and noise on the dc power supply voltage $V_{DD}$ and may further serve as an energy reservoir. The energy reservoir stores extracted energy for a certain time period and ensures that the dc power supply voltage remains charged or powered during short drop outs of the RF antenna signal as discussed below in additional detail. A power supply terminal or input of the sensor 108 is connected to the dc power supply voltage $V_{DD}$ for receipt of operating power. The sensor 108 may comprise various types of active digital and/or analog electronic circuitry and/or display components that need power to function properly.

The microwave powered sensor assembly 100 preferably comprises a housing or casing 110 surrounding and enclosing at least the RF power limiter 104, dc power supply circuit 106 and sensor 108. The housing 110 may be hermetically sealed to protect these circuits and the sensor(s) enclosed therein against harmful liquids, gasses or other contaminants inside the oven chamber. The previously discussed sensory portion of the sensor 108 may protrude from the housing 110 to allow the sensory portion to obtain physical contact with the food item. The housing 110 may comprise an electrically conductive layer or shield, such as a metal sheet or metal net, enclosing at least the RF power limiter 104 and the power supply circuit 106, and optionally the sensor 108, against the strong RF microwave electromagnetic field generated by the microwave oven during operation. The microwave or RF antenna 102 is placed outside the electrically shielded housing 110 to allow harvesting of the microwave energy from the microwave radiation or field.

The measured or detected physical property and/or chemical property of the food item may be indicated to a user of the microwave oven in numerous ways. In certain embodiments of the microwave powered sensor assembly 100, the latter comprises a display configured to displaying parameter values or respective parameter values of the measured physical and/or chemical properties of the food item to the outside of the microwave oven as discussed in further detail below with reference to FIG. 3. In alternative embodiments of the microwave powered sensor assembly 100, the latter comprises a wireless data communication transmitter configured for transmitting the parameter values or respective parameter values of the measured physical and/or chemical properties of the food item to the outside of the microwave oven as discussed in further detail below with reference to FIG. 2.

Figure 2:
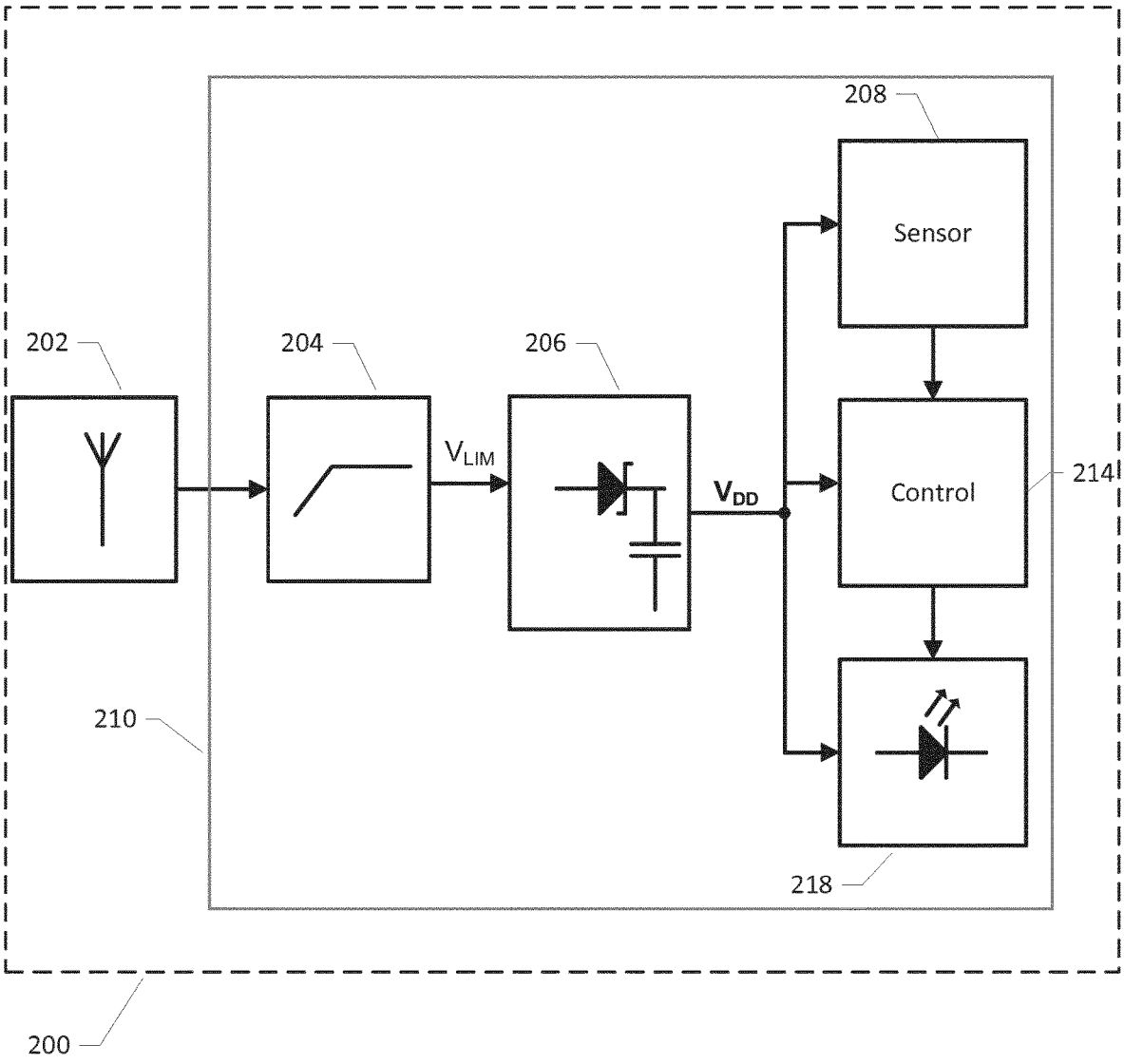
FIG. 2 is a simplified schematic block diagram of a microwave powered sensor assembly for use in microwave ovens in accordance with a second embodiment of the invention.

FIG. 2 is a simplified schematic block diagram of a microwave powered sensor assembly 200 for use in industrial or consumer types of microwave ovens (not shown) in accordance with a second embodiment of the invention. Corresponding elements and features of the first and second embodiments of the microwave powered sensor assembly have been assigned corresponding reference numerals to ease comparison. The microwave powered sensor assembly 200 comprises a microwave antenna 202 which may have identical characteristics to those of the microwave antenna 102 discussed above. An RF antenna signal is electrically coupled to the input of a RF power limiter 204 which may have identical characteristics to those of the optional RF power limiter 104 discussed above. The output of the RF power limiter 204 is coupled to a dc power supply circuit 206 is configured to rectify a limited RF antenna signal $V_{LIM}$ and extract a dc power supply voltage $V_{DD}$ therefrom as discussed above in connection with the first embodiment of the microwave powered sensor assembly 100.

The dc power supply voltage $V_{DD}$ is coupled to respective power supply terminals or inputs of a sensor 208, a controller 214 such as a digital processor and an optical data transmitter 218. Hence, these circuits are connected to the dc power supply voltage $V_{DD}$ for receipt of operating power. The sensor 208 may comprise various types of active digital and/or analog electronic circuitry and/or display components that need power to function properly. The digital processor 214 may comprise a hard-wired digital processor configured to perform various predetermined control functions of the microwave powered sensor assembly 200. In the alternative, the digital processor 214 may comprise a software programmable microprocessor adapted to perform the control functions of the microwave powered sensor assembly 200 in accordance with a set of executable program instructions stored in program memory of the software programmable microprocessor. The digital processor 214 may comprise an input port connected to the sensor 208 for receipt of measured parameter values of the previously discussed physical or chemical properties in question of the food item. A sensory portion of the sensor 208 may be in physical or sensory contact with the food item to measure or detect the physical property of the food item during heating/preparation such as a temperature, viscosity, pressure, colour, humidity, electric conductivity etc. The skilled person will understand that the measured parameter values may be outputted by the sensor 208 in analog format or in digital format depending on the characteristics of the sensor 208 and any signal conditioning circuitry integrated with the sensor. If the parameter values are outputted in digital format, the input port of the digital processor 214 may comprise an ordinary I/O port or an industry standard data communication port such as 12C or SPI. If the parameter values are outputted by the sensor 208 in analog format, the input port of the digital processor 214 may comprise an analog input connected to an internal ND converter to convert the received parameter values to a digital format and create a corresponding data stream or data signal comprising the measured parameter values. The optical data transmitter 218 is coupled to a data port of the digital processor 214 supplying the measured parameter values encoded in a predetermined data format to the optical data transmitter 218 for optical modulation and transmission to a suitable optical receiver (not shown) arranged at the outside of the oven chamber. The optical data transmitter 218 may comprise a modulated LED diode emitting the optical data signal by waves in the visible spectrum or in the infrared spectrum. The optical receiver may comprise a photodetector such as a LED. The digital processor 214 and optical data transmitter 218 may be configured to transmit the optical data signal continuously, at regular time intervals or at irregular time intervals during heating of the food item depending on the particular application. The microwave powered sensor assembly 200 preferably comprises a housing or casing 210 surrounding and enclosing at least the RF power limiter 204, dc power supply circuit 206, digital processor 214, sensor 208 and optical data transmitter 218. The housing 210 may possess the same properties as the housing 110 discussed above.

The microwave oven may comprise a glass lid with an inner surface covered by a metallic net or grid which functions as an EMI shield of the oven to prevent leakage of the microwave radiation emitted by the oven during operation to the external environment outside the oven chamber. The photodetector may be attached directly on an outer surface of the glass lid of the microwave oven such that the optical data signal is transmitted through the glass lid to the photodetector. The photodetector may be placed in an opening of the EMI shield allowing the optical waves carrying the optical data signal unhindered propagation to the photodetector. The photodetector may be electrically or wirelessly coupled to a microprocessor of the microwave oven and transmit the received optical data signal, comprising the measured parameter values, to the controller of the microwave oven. The microprocessor of the microwave oven may be configured to use the received parameter values to control the operation of the microwave oven. In one embodiment, the measured parameter values of the food item may comprise current temperatures of the food item and the microprocessor of the microwave oven may be configured to terminate the heating when the current temperature of the food item reaches a certain target temperature.

Figure 3:
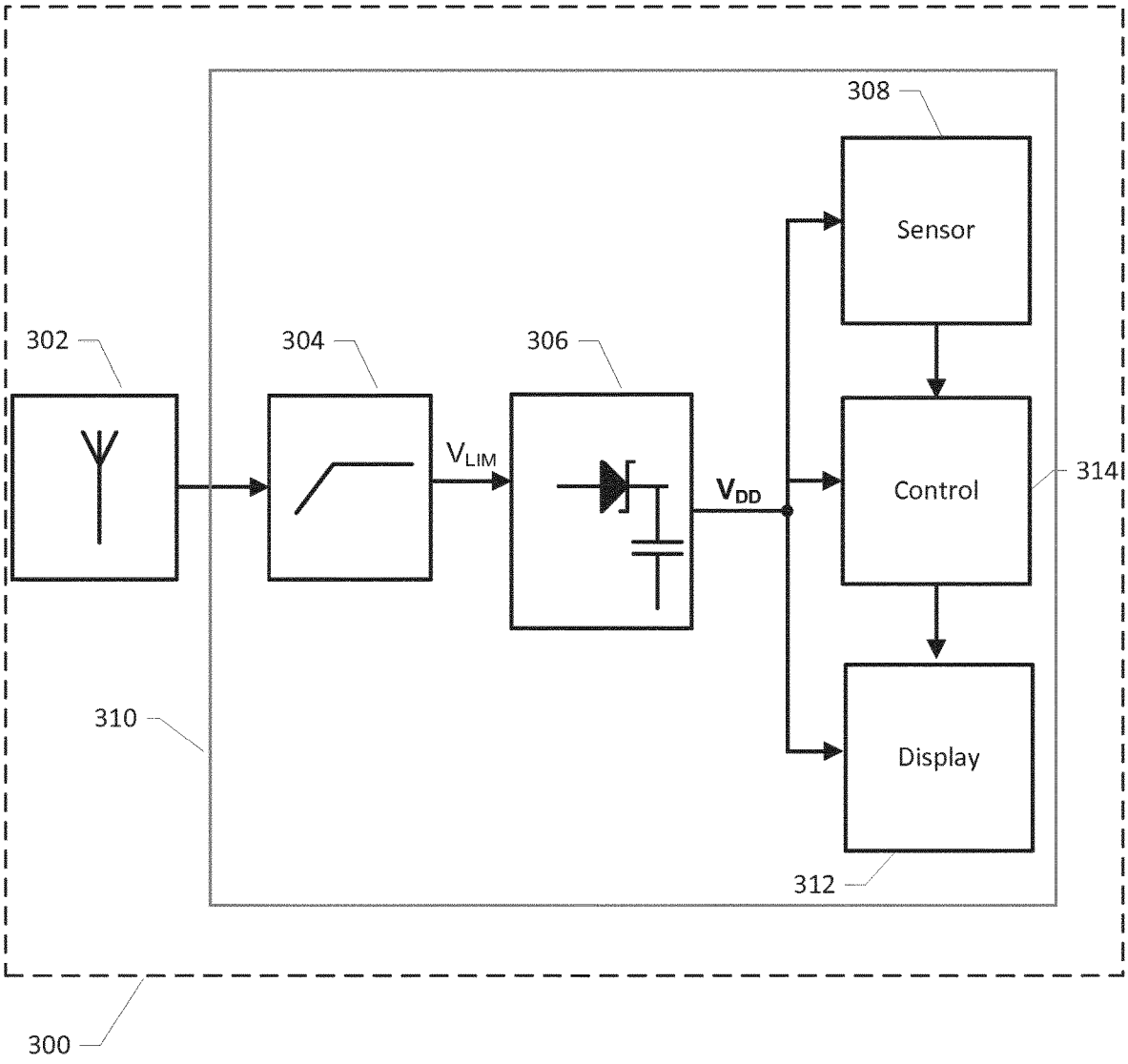
FIG. 3 is a simplified schematic block diagram of a microwave powered sensor assembly for use in microwave ovens in accordance with a third embodiment of the invention, FIG. 4A) shows a simplified electrical circuit diagram of a first exemplary RF power limiter and dc power supply circuit of the microwave powered sensor assemblies in accordance with the first, second or third embodiments of the invention, FIG. 4B) shows a simplified electrical circuit diagram of a second exemplary RF power limiter and dc power supply circuit of the microwave powered sensor assemblies in accordance with the first, second or third embodiments of the invention.

FIG. 3 shows a simplified schematic block diagram of a microwave powered sensor assembly 300 for use in industrial or consumer types of microwave ovens (not shown) in accordance with a third embodiment of the invention. Corresponding elements and features of the second and third embodiments of the microwave powered sensor assembly have been assigned corresponding reference numerals to ease comparison. The main difference between the present microwave powered sensor assembly 300 and the previously discussed microwave powered sensor assembly 200 is that the optical data transmitter 218 has been replaced by a display 312. The display 312 functions as a parameter indicator for displaying the measured parameter values of the physical or chemical property of the food item to the exterior of the oven chamber. The display 312 is also powered by a dc power supply voltage $V_{DD}$ generated by a dc power supply circuit 306 of the microwave powered sensor assembly 300. As discussed above, the dc power supply circuit 306 extracts energy or power from a limited RF antenna signal $V_{LIM}$. However, the RF power limiter 304 is an optional circuit and other embodiments of the microwave powered sensor assembly may couple an RF antennal signal directly to the dc power supply circuit 306 without any intermediate RF signal limiting. The display 312 functions as a parameter indicator for displaying parameter values of the monitored physical or chemical property or properties of the food item to the exterior of the oven chamber. The display 312 is preferably configured to indicate the measured parameter values with sufficient size and/or brightness to allow a user to read a current parameter value through a glass door or lid of the oven during operation of the oven. The display 312 may comprise various types of parameter value indicators such as a LED, multiple LEDs of different color, a loudspeaker, an alphanumeric display and E-ink paper. The microwave powered sensor assembly 300 preferably comprises a housing or casing 210 surrounding and enclosing at least the RF power limiter 304, dc power supply circuit 306, digital processor 314, sensor 308 and display 312. The housing 210 may possess the same properties as the housing 110 discussed above.

Figure 4:
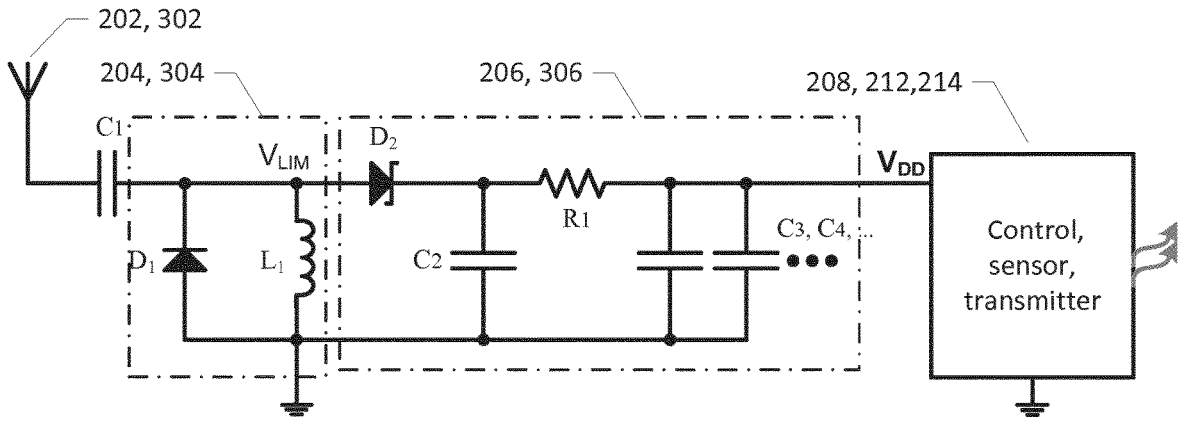
Figure 4:
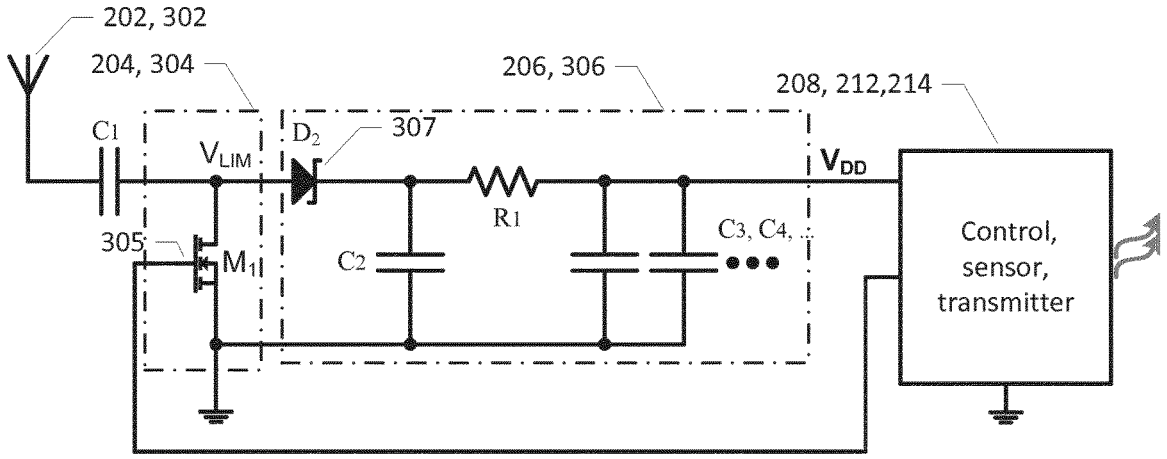

FIG. 4A) shows a simplified electrical circuit diagram of a first exemplary RF power limiter 204,304 and dc power supply circuit 206,306 suitable for use in any of the above discussed first, second and third embodiments of the present microwave powered sensor assembly. The RF power limiter comprises a PIN limiter diode and a parallel inductor L1. The PIN limiter diode D1 is coupled from the RF antenna signal to ground of the RF power limiter and presents a variable shunt impedance to the microwave antenna 202,302 where the shunt impedance varies with a level of the incoming RF antenna signal. The RF power limiter therefore generates a limited or attenuated RF antenna signal $V_{LIM}$ compared to the RF antenna signal produced at the output of the microwave antenna 202, 302. The limited RF antenna signal $V_{LIM}$ is applied to the input of the dc power supply circuit 206,306, in particular to a cathode of a rectifying element in form of Schottky diode $D_2$. The parallel inductor ensures proper DC biasing of the PIN limiter diode D1. The impedance of the PIN limiter diode is relatively large, for example larger than 1000 ohm, for small levels of the RF antenna signal and gradually decreases with increasing level of the RF antenna signal such that the input impedance of the RF power limiter behaves in a corresponding manner. In one exemplary embodiment, the generator impedance of the microwave antenna may be about 1000 ohm, the input impedance of the dc power supply about 200 ohm and the impedance of the PIN limiter diode above 1000 ohm for small levels of the RF antenna signal. With increasing level of the RF antenna signal the impedance of the PIN limiter diode may gradually decrease to reach a value of about 50 ohm or even smaller for large levels of the RF antenna signal. Hence, the impedance matching between the microwave antenna and the RF power limiter is gradually deteriorating with increasing level of the RF antenna signal. Consequently, as the level of the RF antenna signal increases an increasing portion of the RF antenna signal is reflected back to the microwave antenna and emitted therefrom. Hence, shielding the components of the dc power supply circuit against excessive RF voltage levels and power levels which could lead to the previously discussed overvoltage and/or overheating problems for large levels of the RF antenna signal.

FIG. 4B) shows a simplified electrical circuit diagram of a second exemplary RF power limiter 204,304 and dc power supply circuit 206,306 suitable for use in any of the above discussed first, second and third embodiments of the present microwave powered sensor assembly. The RF power limiter comprises a controllable MOSFET transistor $M_1$. The controllable MOSFET $M_1$ is coupled from the RF antenna signal to ground of the RF power limiter and presents a variable shunt impedance to the microwave antenna where the impedance varies in accordance with the level of the incoming RF antenna signal. However, while the impedance characteristics and signal limiting characteristics of the PIN limiter diode is fixed by the intrinsic parameters of the PIN diode itself, the signal limiting characteristics of the MOSFET $M_1$ can be accurately controlled by the digital processor 214, 314 by controlling or adjusting a gate voltage of the gate/control terminal 305 of $M_1$. This feature provides considerable flexibility in controlling or adapting the impedance characteristics and therewith signal limiting characteristics of the present embodiment of the RF power limiter. The digital processor 214, 314 may for example monitor the level of dc power supply voltage $V_{DD}$ via a suitable input port. The digital processor may be configured to abruptly or gradually decrease the impedance of $M_1$ via adjustment of the gate voltage of $M_1$ in response to the dc power supply voltage $V_{DD}$ meets a certain criterion for example reaches a threshold voltage. The latter may indicate a nominal DC voltage of the supply or indicate a fully charged state of the dc power supply circuit 106, 206, 306 such that the amount of incoming power from the RF antenna signal could advantageously be lowered to avoid the previously discussed potentially harmful overvoltage conditions in the dc power supply circuit. The digital processor may control the impedance of $M_1$ such that it remains substantially constant below the predefined threshold level and decreases to a smaller impedance above the threshold level. The smaller impedance of $M_1$ above the predefined threshold level may either be substantially constant or variable such that the impedance gradually decreases with increasing dc power supply voltage.

Figure 5:
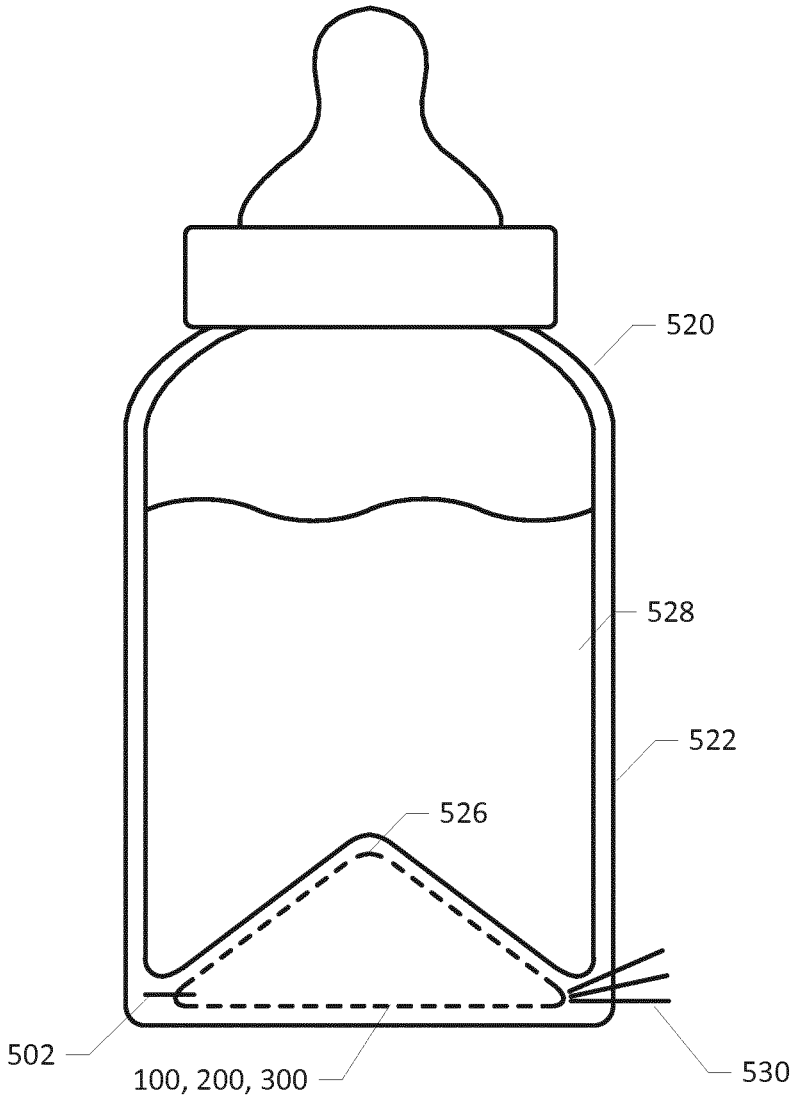
FIG. 5 shows a bottle with baby formula comprising an integrated microwave powered sensor assembly in accordance with any of the above embodiments of the assembly.

FIG. 5 shows a first exemplary food container 520 which comprises a baby bottle. The baby bottle contains a portion of infant formula 528. The baby bottle 520 comprises an integrated microwave powered sensor assembly 100, 200, 300 in accordance with any of the above embodiments thereof. The baby bottle 520 is designed for use in consumer type of microwave ovens using 2.45 GHz microwave radiation. The microwave powered sensor assembly preferably comprises housing or casing surrounding and enclosing the previously discussed circuits of the integrated microwave powered sensor assembly. The housing may possess the same properties as the housing 110 discussed above in connection with the first embodiment of the microwave powered sensor assembly 100. The microwave powered sensor assembly is arranged in a bottom section of a bottle wall 522 of the baby bottle 520. The bottle wall 522 may comprise polycarbonate and therefore be fairly transparent to infrared light and/or visible light. A temperature sensor 526 protrudes from the housing of the microwave powered sensor assembly to achieve physical contact with the infant formula 528 and measure its current temperature. In the alternative, the temperature sensor 526 may be arranged inside the housing and obtain thermal contact with the infant formula 528 through a suitable material interface. The microwave powered sensor assembly comprises a relatively short monopole microwave antenna 502. The tuning frequency of the monopole microwave antenna 502 is preferably somewhat higher than the 2.45 GHz radiation frequency of microwave radiation of the microwave oven. Hence, the monopole microwave antenna 502 is deliberately detuned which offers several advantages. The higher tuning frequency of the monopole microwave antenna 502 relative to at tuning at the 2.45 GHz microwave radiation frequency leads to smaller physical dimensions of the monopole microwave antenna 502. The smaller physical dimensions leads to smaller dimensions of the microwave powered sensor assembly and simper integration into the various kinds of equipment such as the present infant bottle 510. The detuning also decreases the amount of microwave energy picked-up by the monopole microwave antenna 502 and therefore decreases the level of the RF antenna signal level applied to either the RF power limiter 204, 304 (if present) and to the dc power supply circuit 206, 306. The tuning frequency of the monopole microwave antenna 502 relative to at tuning at the 2.45 GHz microwave radiation frequency may be at least 50% higher leading to a turning frequency of the monopole microwave antenna 502 at or above 3.675 GHz in the present embodiment. The microwave powered sensor assembly comprises further comprises an optical data transmitter as discussed in connection with the second embodiment of the microwave powered sensor assembly 200. The optical data transmitter is configured to emit an optical data signal 530 comprising measured temperature values of the infant formula 528 as produced by the temperature sensor 526 during heating of the baby bottle in the oven. The optical data signal 530 may be infrared and has a sufficiently large level or power to penetrate the bottle wall 522 and penetrate an oven door to reach an optical receiver placed outside the oven chamber as discussed above. The skilled person will understand that the optical data transmitter may be replaced by, or supplemented by, a display such as the display 312 discussed above. The display may indicate the measured temperature values of the infant formula 528 or simply indicate that a certain preprogramed target temperature of the infant formula is reached to the exterior of the oven chamber. The user may monitor the current temperature of the infant formula by reading temperature indications on the display during heating and interrupt the oven when a desired temperature is reached. In the alternative, the previously discussed microprocessor of the microwave oven may be configured to automatically interrupt the heating of the microwave oven when the desired temperature is reached. This requires that the optical data signal transmitted by the microwave powered sensor assembly is coupled to the microprocessor of the microwave oven via the photodetector mounted on the oven door as discussed above.

Figure 6:
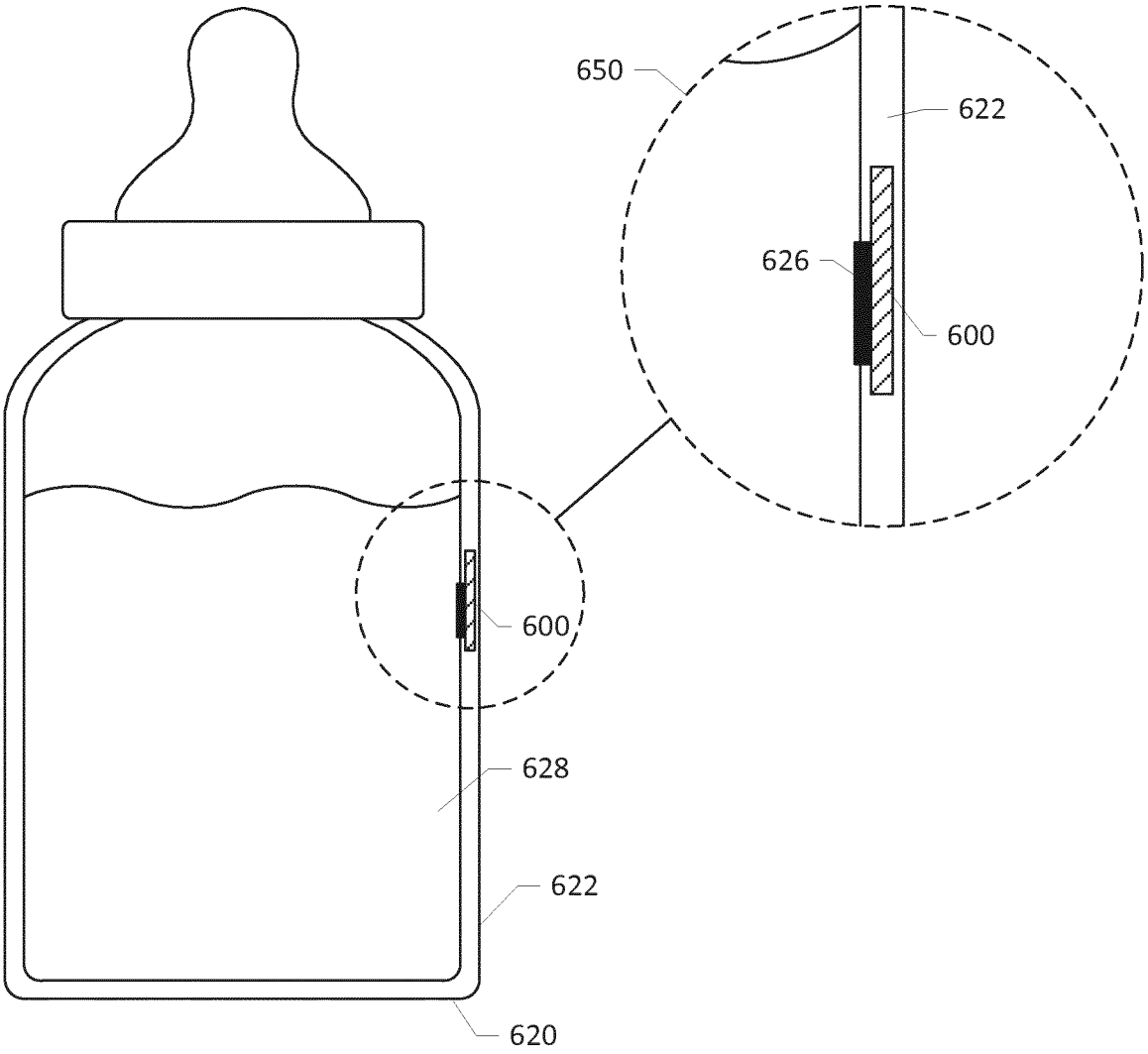
FIG. 6 shows an exemplary food container with a microwave powered sensor assembly integrated in wall section of the food container.

FIG. 6 shows a second exemplary food container 620 for example in the form of a baby bottle. The food container 620 comprises a microwave powered sensor assembly 600 in accordance with any of the above described embodiments 100, 200, 300 thereof. The microwave powered sensor assembly 600 is partially, or fully, embedded in a wall section 622 of the container material or possibly other container sections. The microwave powered sensor assembly 600 may have been embedded in the wall section 615 of the food container 620 using manufacturing techniques such as injection moulding or by overmoulding. The food container 620 may comprise various types of injection moulding compatible materials. A sensor 626, for example a temperature sensor or a chemical sensor, of the microwave powered sensor assembly 600 is arranged to obtain physical contact with a food item 628 (e.g. baby formula) held in the food container 620. The zoomed drawing section 650 of the wall section 622 surrounding the microwave powered sensor assembly 600 illustrates how the sensor 626 at least partly protrudes to the outside of inner surface of the wall material to obtain physical contact with the food item 628.

Figure 7:
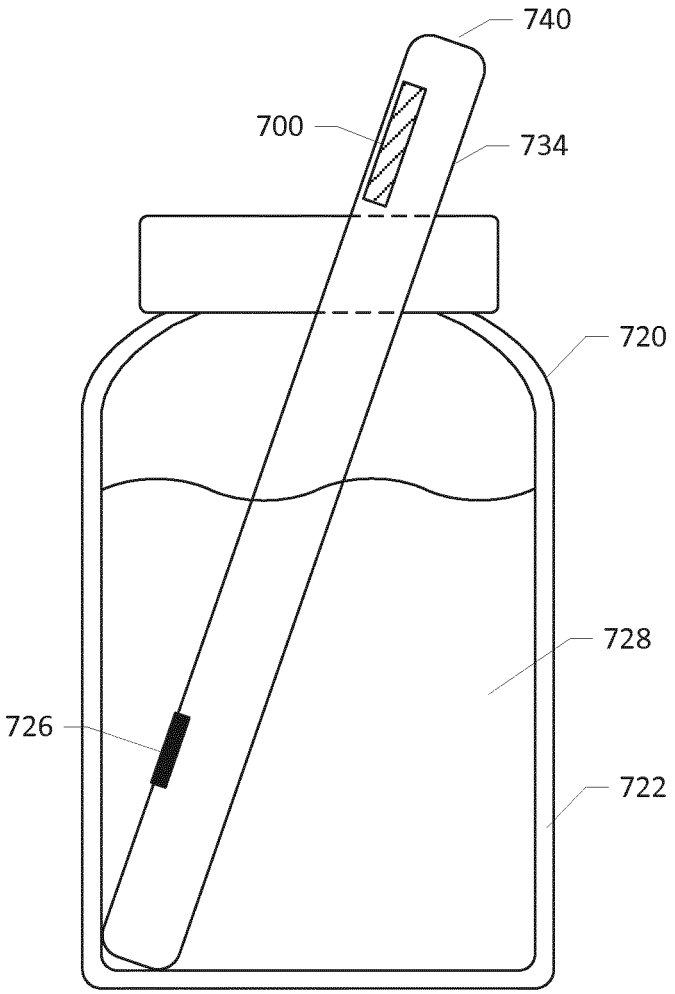
FIG. 7 shows a temperature probe which comprises a microwave powered sensor assembly in accordance with any of the above embodiments thereof.

FIG. 7 shows an exemplary temperature probe 740 comprising a microwave powered sensor assembly according to any of the previously-discussed embodiments 100, 200, 300 thereof. The temperature probe 740 possesses numerous uses and may for example be inserted into a food item 728 held in a food container 720 such as a cup, bottle etc. in connection with microwave heating of the food item 728. The microwave powered sensor assembly comprises a main portion 700 and a sensor portion 726 arranged physically separate from the main portion 700. The separate sensor portion 726 may be electrically connected to the main portion 700 via one or more electrical conductors or wires. Alternatively, the sensor portion 726 and main portion 700 may be connected via a wireless data communication link. The microwave powered sensor assembly is preferably enclosed or arranged within a housing or casing 734 of the temperature probe 740 for example an elongate cylindrical housing to facilitate end user manipulation and handling. The temperature probe 740 may be inserted in the food item 728 during use such that at least the sensor portion 726 is embedded in the food item 728 to accurately measure the relevant physical and/or chemical properties of the food item 728 during its heating in the microwave oven chamber.

What is claimed is:

1. A microwave powered sensor assembly for microwave ovens, the assembly comprising:

a microwave antenna having a predetermined tuning frequency to generate a radio frequency (RF) antenna signal in response to microwave radiation at a predetermined excitation frequency;

an RF power limiter coupled to the microwave antenna to limit an amplitude or power of the RF antenna signal in accordance with predetermined signal limiting characteristics to produce a limited RF antenna signal;

a direct current (dc) power supply circuit coupled to the RF power limiter and configured to receive the limited RF antenna signal, rectify the limited RF antenna signal, and produce a power supply voltage, wherein the produced power supply voltage is derived from the limited RF antenna signal generated by the RF power limiter; and a sensor coupled to the dc power supply circuit and configured to receive the power supply voltage and measure a physical or chemical property of a food item being heated in a microwave oven chamber.

2. The microwave powered sensor assembly of claim 1, wherein the RF power limiter comprises a variable impedance circuit connected across the RF antenna signal, wherein the variable impedance circuit is configured to exhibit a decreasing input impedance with increasing amplitude or power of the RF antenna signal at the predetermined excitation frequency to decrease a matching between the input impedance of the RF power limiter and an impedance of the microwave antenna.

3. The microwave powered sensor assembly of claim 2, wherein the variable impedance circuit comprises a P-type, intrinsic, and N-type (PIN) limiter diode or a controlled field-effect transistor (FET).

4. The microwave powered sensor assembly of claim 2, wherein the variable impedance circuit is configured to:

exhibit a first constant input impedance at power levels of the RF antenna signal below a threshold level; and exhibit a second gradually decreasing input impedance at power levels of the RF antenna signal above the threshold level.

5. The microwave powered sensor assembly of claim 1, wherein the power supply circuit comprises one or more RF Schottky diode(s) to rectify the limited RF antenna signal.

6. The microwave powered sensor assembly of claim 1, wherein the predetermined tuning frequency of the microwave antenna deviates from the predetermined excitation frequency of the microwave radiation by more than +50% or more than −33%.

7. The microwave powered sensor assembly of claim 6, wherein the predetermined tuning frequency of the microwave antenna is at least 50% higher than the predetermined excitation frequency of the microwave radiation.

8. The microwave powered sensor assembly of claim 1, wherein the microwave antenna comprises at least one of a monopole antenna, a dipole antenna, or a patch antenna.

9. The microwave powered sensor assembly of claim 1, wherein a generator impedance of the microwave antenna is at least two times larger than an input impedance at the RF power limiter at the predetermined excitation frequency of the microwave radiation in the microwave oven chamber.

10. The microwave powered sensor assembly of claim 1, further comprising an electrically conductive housing configured to enclose and shield at least the RF power limiter and the power supply circuit against the microwave radiation.

11. The microwave powered sensor assembly of claim 1, further comprising:

a digital processor coupled to the power supply voltage for receipt of operating power, wherein the digital processor is coupled to the sensor via an input port for receipt of parameter values of the measured physical or chemical property of the food item.

12. The microwave powered sensor assembly of claim 11, further comprising:

an optical data transmitter coupled to the digital processor for receipt and optical transmission, to an exterior of the microwave oven chamber, of the parameter values of the measured physical or chemical property of the food item.

13. The microwave powered sensor assembly of claim 1, further comprising a parameter indicator to display parameter values of the monitored physical or chemical property of the food item to an exterior of the microwave oven chamber, wherein the parameter indicator comprises at least one indicator selected from a light-emitting diode (LED), multiple LEDs of different colors, a loudspeaker, an alphanumeric display, or E-ink paper.

14. An apparatus comprising:

a microwave powered sensor assembly comprising:

a microwave antenna having a predetermined tuning frequency to generate a radio frequency (RF) antenna signal in response to microwave radiation at a predetermined excitation frequency;

an RF power limiter coupled to the microwave antenna to limit an amplitude or power of the RF antenna signal in accordance with predetermined signal limiting characteristics to produce a limited RF antenna signal;

a direct current (dc) power supply circuit coupled to the RF power limiter and configured to receive the limited RF antenna signal and configured to rectify the limited RF antenna signal and produce a power supply voltage, wherein the produced power supply voltage is derived from the limited RF antenna signal generated by the RF power limiter; and a sensor arranged to obtain physical contact or sensory contact with a food item.

15. The apparatus of claim 14, wherein the microwave powered sensor assembly is partially or fully embedded in a wall section, a lid section, or a bottom section of a food container.

16. The apparatus of claim 14, wherein the microwave powered sensor assembly is partially or fully embedded in a food probe.

* * * * *